US007753497B2

(12) United States Patent
Yagi

(10) Patent No.: US 7,753,497 B2
(45) Date of Patent: Jul. 13, 2010

(54) PIEZOELECTRIC ELEMENT, LIQUID DROPLET EJECTION HEAD, AND LIQUID DROPLET EJECTION APPARATUS

(75) Inventor: Takashi Yagi, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 651 days.

(21) Appl. No.: 11/055,414

(22) Filed: Feb. 10, 2005

(65) Prior Publication Data

US 2006/0055745 A1 Mar. 16, 2006

(30) Foreign Application Priority Data

Sep. 14, 2004 (JP) ..... 2004-267349

(51) Int. Cl.
*B41J 29/38* (2006.01)

(52) U.S. Cl. ..... 347/71; 128/200.13; 29/25.35; 347/68; 347/70; 347/72

(58) Field of Classification Search ..... None
See application file for complete search history.

(56) References Cited

U.S. PATENT DOCUMENTS 3,447,217 A * 6/1969 Akio ..... 29/25.35
3,912,830 A * 10/1975 Murayama et al. ..... 427/100
6,046,524 A * 4/2000 Yamanouchi et al. ... 310/313 R
6,142,615 A * 11/2000 Qiu et al. ..... 347/70
6,347,862 B1 * 2/2002 Kanno et al. ..... 347/68
6,546,927 B2 * 4/2003 Litherland et al. ..... 128/200.16
6,767,086 B2 * 7/2004 Murai ..... 347/70
7,298,018 B2 * 11/2007 Ezhilvalavan et al. ..... 257/532
7,322,244 B2 * 1/2008 Kim ..... 73/587
2002/0180843 A1 * 12/2002 Irie et al. ..... 347/70
2004/0051763 A1 * 3/2004 Matsubara et al. ..... 347/68
2005/0052506 A1 * 3/2005 Yagi et al. ..... 347/72
2005/0134652 A1 * 6/2005 Iwashita et al. ..... 347/68
2007/0019040 A1 * 1/2007 Seto et al. ..... 347/68

FOREIGN PATENT DOCUMENTS

JP 2003-080698 3/2003

* cited by examiner

*Primary Examiner*—Matthew Luu
*Assistant Examiner*—John P Zimmermann
(74) *Attorney, Agent, or Firm*—Fildes & Outland, P.C.

(57) ABSTRACT

A metal oxide layer is disposed on the lower potential side when an electric field in a predetermined direction is applied to the piezoelectric body which is deformed by an applied electric field, and compensates for the oxygen vacancies which are generated in the piezoelectric body by applying the electric field. A second metal oxide layer is disposed on the higher potential side of the electric field applied to the piezoelectric body, and by applying an electric field in the direction reverse to the electric field, compensates for the oxygen vacancies which are accumulated in the piezoelectric body, thus degradation of the piezoelectric characteristic of a piezoelectric element can be repaired.

22 Claims, 8 Drawing Sheets

144
(HIGHER POTENTIAL)
(LOWER POTENTIAL)
158
164
156
166
160
180
182
COMPENSATION
$V^{2+}$
$O^{2-}$
:OXYGEN VACANCY
:OXYGEN ION
:OXYGEN ATOM

PIEZOELECTRIC ELEMENT, LIQUID DROPLET EJECTION HEAD, AND LIQUID DROPLET EJECTION APPARATUS

CROSS-REFERENCE TO RELATED APPLICATION

This application claims priority under 35 USC 119 from Japanese Patent Application No. 2004-267349, the disclosure of which is incorporated by reference herein.

BACKGROUND OF THE INVENTION

1. Field of the Invention

The present invention relates to a piezoelectric element including a piezoelectric body layer which is deformed in accordance with a voltage applied thereto, a liquid droplet ejection head including plural the piezoelectric elements, and a liquid droplet ejection apparatus including the liquid droplet ejection head.

2. Description of the Related Art

Conventionally, liquid droplet ejection apparatuses, such as ink jet printers, comprise a liquid droplet ejection head for ejecting ink liquid droplets. This liquid droplet ejection head comprises plural liquid droplet ejection ports, plural pressure generating chambers each connected to the respective liquid droplet ejection ports, and a piezoelectric element actuator for each pressure generating chamber; generates a pressure wave (an acoustic wave) to the liquid filled up in the pressure generating chamber, using the piezoelectric element actuator; and by that pressure wave, ejects ink liquid droplets from the liquid droplet ejection port connected to the pressure generating chamber. Generally, the piezoelectric element actuator is configured to comprise a piezoelectric element which is deformed in accordance with a voltage applied thereto, and a diaphragm which dilates and contracts the pressure generating chamber by the deformation of the piezoelectric element.

Conventionally, such a piezoelectric element is constructed by film formation of a piezoelectric body layer, and an electrode layer on the front and back surfaces of the piezoelectric body layer in sequence, and as examples of materials, gold/nickel/chromium for the first electrode layer, a piezoelectric material for the piezoelectric body layer, and chromium/gold for the second electrode layer can be mentioned.

When a voltage is applied to the respective piezoelectric elements in the liquid droplet ejection head thus configured as above for driving them to cause the respective liquid droplet ejection ports to eject ink liquid droplets, there arises a difference in the polarization condition among the piezoelectric elements due to the difference in the driving history among them, resulting in the amount of deformation displacement (the piezoelectric characteristic) varying even if an electric field of a given potential difference is applied, and a variation in the amount of ink liquid droplet which is ejected from a particular liquid droplet ejection port may be caused.

Then, in Laid-Open Publication 2003-80698, the art for canceling the polarization by applying a voltage reverse to that applied to the piezoelectric element when ink liquid droplets are ejected is disclosed. With this art, the variation in the amount of ink liquid droplet ejected from a particular liquid droplet ejection port can be suppressed.

However, although, with the art as disclosed in Laid-Open Publication 2003-80698, the variation in the amount of ink liquid droplet ejected can be suppressed, there has been a problem that the longer the period of time of driving the liquid droplet ejection head, the heavier the degradation of the piezoelectric characteristic of the piezoelectric element itself will be. If the degradation of the piezoelectric element is progressed, the amount of displacement when the electric field is applied is reduced, which may make the ejection of ink liquid droplets impossible.

SUMMARY OF THE INVENTION

The present invention has been made in view of the above circumstances and provides a piezoelectric element with which the degradation of the piezoelectric characteristic can be corrected for, a liquid droplet ejection head, and a liquid droplet ejection apparatus.

To achieve the above purpose, a first aspect of the present invention provides a piezoelectric element including: a piezoelectric body layer which is deformed by an applied electric field; a first metal oxide layer which is disposed adjacent to the piezoelectric body layer on the lower potential side when an electric field in a predetermined direction is applied to the piezoelectric body layer, and which suppresses the degradation of the piezoelectric body layer that is caused by application of the electric field; and a second metal oxide layer which is disposed adjacent to the piezoelectric body layer on the higher potential side of the electric field which is applied to the piezoelectric body layer, and which, by applying an electric field in the direction reverse to the electric field, repairs the piezoelectric body layer degraded.

In other words, for the above-mentioned degradation of the piezoelectric characteristic, the higher the humidity, the rapider the progress of degradation will be, even if the piezoelectric elements have been manufactured under the same conditions. As the cause for this, it is known that drops of water are deposited onto the piezoelectric element; the synergistic effect of the electric field and the electric current on the voltage applied when the piezoelectric element is driven deoxidizes the piezoelectric body to generate oxygen vacancies (positively charged); and the generated oxygen vacancies are accumulated on the lower potential side of the piezoelectric body layer, resulting in a low dielectric constant layer being formed.

Then, with a piezoelectric element of the first aspect of the present invention, a first metal oxide layer is disposed adjacent to the piezoelectric body layer on the lower potential side when an electric field in the predetermined direction is applied to the piezoelectric body layer which is deformed by an electric field being applied thereto, and which suppresses the degradation of the piezoelectric body layer that is caused by application of the electric field; and a second metal oxide layer is disposed adjacent to the piezoelectric body layer on the higher potential side of the electric field which is applied to the piezoelectric body layer, and which, by applying an electric field in the direction reverse to the electric field, repairs the piezoelectric body layer degraded.

Therefore, according to the first aspect of the present invention, because the first metal oxide layer is disposed adjacent to the piezoelectric body layer on the lower potential side when an electric field in the predetermined direction is applied to the piezoelectric body layer, and which suppresses the degradation of the piezoelectric body layer that is caused by application of the electric field; and the second metal oxide layer is disposed adjacent to the piezoelectric body layer on the higher potential side of the electric field which is applied to the piezoelectric body layer, and which, by applying an electric field in the direction reverse to the electric field, repairs the piezoelectric body layer degraded, the degradation of the piezoelectric characteristic can be corrected for.

Further, at least one of the first metal oxide layer or the second metal oxide layer may be made up of an electrically non-conductive material, and on the side opposite to the side facing the piezoelectric body layer of the first metal oxide layer or the second metal oxide layer made up of the electrically non-conductive material, an electrode layer made of a metal or an electrically conductive metal oxide may be further provided (a second aspect).

In the first or second aspect, it is preferable that the first metal oxide layer and the second metal oxide layer be made up of a material containing at least one of iridium, tin, ruthenium, rhenium, rhodium, palladium, strontium, indium, titanium, zirconium, niobium, magnesium, silicon, tantalum, aluminum, zinc, manganese, cobalt, osmium, and hafnium (a third aspect)

To achieve the above purpose, a fourth aspect of the present invention comprises plural piezoelectric elements of any one of the first to third aspects; plural pressure generating chambers which are each provided for the respective piezoelectric elements, and which volume of the inside filled with ink liquid droplets is changed, being pressurized from the outside by the deformation of the piezoelectric body layer provided in the piezoelectric element; and a liquid droplet ejection port which is connected to the pressure generating chamber, and ejects the ink liquid droplets by a pressure wave generated by the change in volume of the pressure generating chamber.

Then, with a liquid droplet ejection head of the fourth aspect of the present invention, the plural pressure generating chambers are each provided for each of the plural piezoelectric elements of any one of the first to third aspects; the volume of the inside filled with ink liquid droplets is changed, being pressurized from the outside by the deformation of the piezoelectric body layer provided in the piezoelectric element; the liquid droplet ejection port is connected to the pressure generating chamber; and the ink liquid droplets are ejected by a pressure wave generated by the change in volume of the pressure generating chamber.

Therefore, according to the fourth aspect of the present invention, because the liquid droplet ejection head is provided with plural piezoelectric elements of any one of the first to third aspects, the same effects as the first aspect can be obtained.

On the other hand, to achieve the above purpose, a fifth aspect of the present invention comprises a liquid droplet ejection head of the fourth aspect; an electric field application section which applies an electric field to the piezoelectric element provided in the liquid droplet ejection head; a degradation detection section which detects the degradation level of the piezoelectric element; and a control section which controls the electric field application section such that, when the degradation level detected by the degradation detection section is under the predetermined level and the ink liquid droplets are caused to be ejected, an electric field in the predetermined direction is applied to the piezoelectric element, and when the degradation level detected by the degradation detection section is equal to or over the predetermined level, an electric field in the direction reverse to the predetermined direction is applied to the piezoelectric element.

The electric field application section applies an electric field to the piezoelectric element provided in the liquid droplet ejection head of the fourth aspect; the degradation detection section detects the degradation level of the piezoelectric element; and the control section controls the electric field application section such that, when the degradation level detected by the degradation detection section is under the predetermined level and the ink liquid droplets are caused to be ejected, an electric field in the predetermined direction is applied to the piezoelectric element, and when the degradation level detected by the degradation detection section is equal to or over the predetermined level, an electric field in the direction reverse to the predetermined direction is applied to the piezoelectric element.

Therefore, according to the fifth aspect of the present invention, the degradation of the piezoelectric characteristic can be effectively corrected for.

In the fifth aspect of the present invention, the degradation detection section may detect the degradation level of the piezoelectric element on the basis of the change in the electrical characteristic of the piezoelectric element (a sixth aspect).

In the fifth or sixth aspect of the present invention, it is preferable that, when the electric field application section applies an electric field in the direction reverse to the predetermined direction, it apply, to the piezoelectric element in the direction reverse to the predetermined direction, a voltage which value is lower than the predetermined voltage which is applied to the piezoelectric element when the electric field is applied in the predetermined direction, and which frequency is higher than the predetermined frequency which is applied to the piezoelectric element in the direction reverse to the predetermined direction (a seventh aspect).

As described above, according to the present invention, the first metal oxide layer is disposed adjacent to the piezoelectric body layer on the lower potential side when an electric field in a predetermined direction is applied to the piezoelectric body layer, and which suppresses the degradation of the piezoelectric body layer that is caused by application of the electric field; and the second metal oxide layer is disposed adjacent to the piezoelectric body layer on the higher potential side of the electric field which is applied to the piezoelectric body layer, and which, by applying an electric field in the direction reverse to the electric field, repairs the piezoelectric body layer degraded. Thus, the present invention has excellent effects in that it can provide a piezoelectric element, a liquid droplet ejection head, and a liquid droplet ejection apparatus which are capable of repairing the degradation of the piezoelectric characteristic.

DETAILED DESCRIPTION OF THE INVENTION

Figure 1:
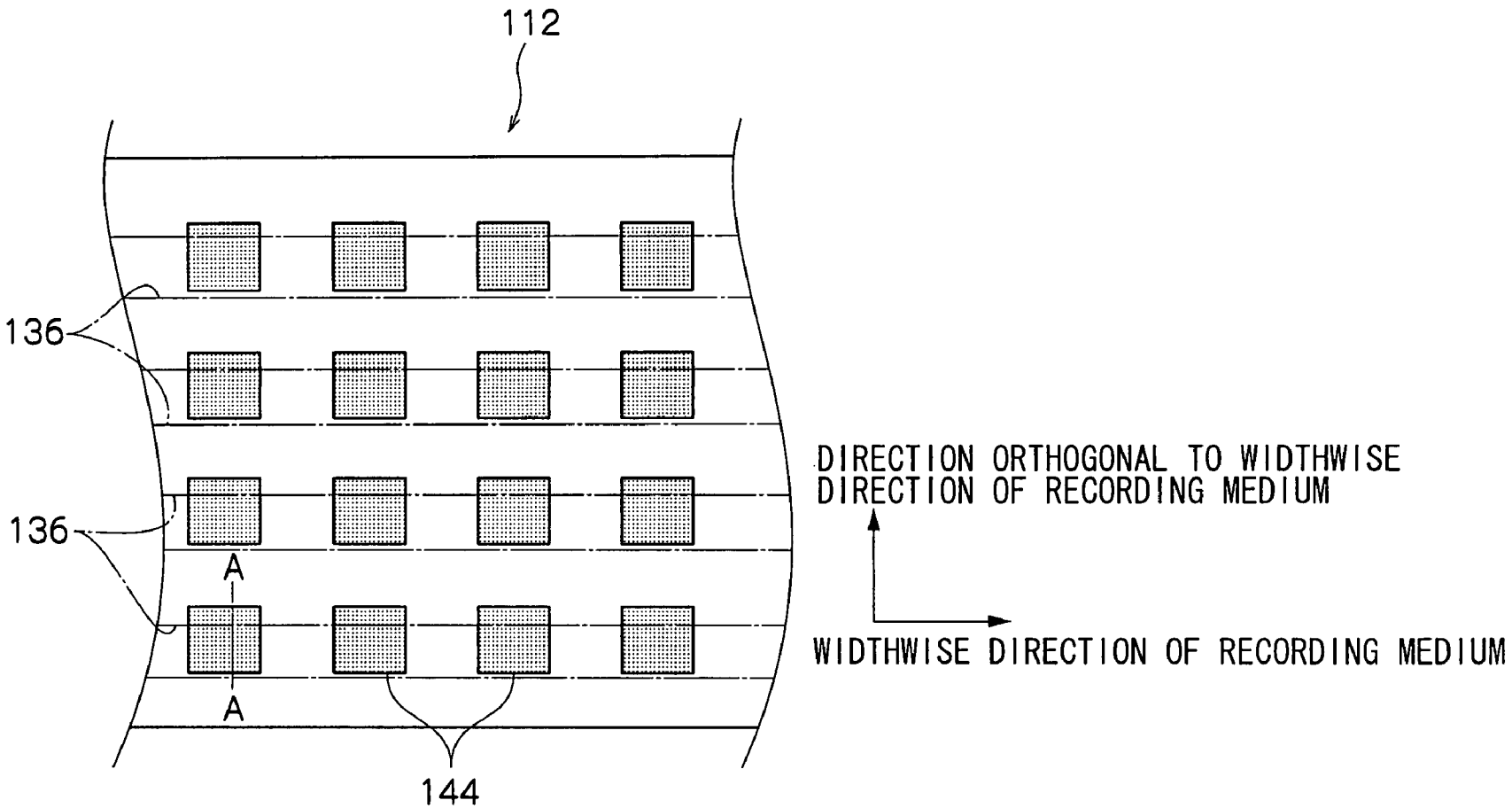
FIG. 1 is a plan view illustrating the configuration of a liquid droplet ejection head according to the present embodiment.

Hereinafter, the present embodiment will be explained in detail with reference to the drawings.

First, a piezoelectric body layer constituting a piezoelectric element according to the present embodiment will be described. As a material constituting the piezoelectric body layer, the material is not specifically limited; however, it is preferably a well-known piezoelectric body material which can be deformed when subjected to a voltage. However, as a piezoelectric element for liquid droplet ejection, for example, it is preferable from the viewpoint of the necessary characteristic that a lead zirconate titanate (PZT) family piezoelectric body, which has a relatively high piezoelectric constant, be used. Especially, modified PZT, which is formed by adding a donor (Nb, for example) to PZT, has a high piezoelectric constant, and is suited for liquid droplet ejection applications.

The thickness of the piezoelectric body layer is not specifically limited; however, it is preferably in the range of 1 to 50 μm for practical use.

On both faces of the piezoelectric body layer, a metal oxide layer (which may either be electrically conductive or electrically non-conductive) is formed by using a well-known film formation method, e.g., a vapor phase film formation method, such as the sputtering method or the CVD method, or a liquid phase film formation method, such as the sol-gel method. As a metal oxide constituting the metal oxide layer, the metal oxide is not limited as long as it is a well-known metal oxide; however, it is preferably a metal oxide containing at least one of the metallic elements, i.e., iridium, tin, ruthenium, rhenium, rhodium, palladium, strontium, indium, titanium, zirconium, niobium, magnesium, silicon, tantalum, aluminum, zinc, manganese, cobalt, osmium, and hafnium. Especially, a metal oxide containing iridium (Ir), ruthenium (Ru), or tin (Sn) among these metallic elements is more preferable because such element can increase the capacity of supplying oxygen to the piezoelectric body layer.

The thickness of the metal oxide layer made of such a metal oxide is preferably in the range of 50 nm to 1 μm, and more preferably in the range of 100 nm to 0.5 μm.

If the thickness of the metal oxide layer is smaller than 50 nm, oxygen vacancies are accumulated on the lower potential electrode layer side of the piezoelectric element especially under high humidity, which may result in the piezoelectric characteristic being degraded with time. If the thickness of the metal oxide layer is greater than 1 μm, the metal oxide layer may impede the deformation of the piezoelectric element or make it impossible to secure a sufficient amount of displacement that is required of a piezoelectric element.

The electrical conductivity of the metal oxide layer is not limited; however, when it is electrically conductive, the metal oxide layer can be adapted to function as the electrode layer. On the other hand, when the metal oxide layer is electrically non-conductive, it is required to provide the electrode layer made of an electrically conductive material, such as a well-known metal or an electrically conductive metal oxide, on the face of the metal oxide layer on the side opposite to the piezoelectric body layer side. When the electrode layer is formed, a well-known electrically conductive material, such as a metal or an electrically conductive metal oxide, is formed by using the above well-known film formation method. When the electrode layer is configured as two or more layers, another electrically conductive material may be further formed on the surface of the metallic layer by using the well-known film formation method. When the metal oxide layer is electrically non-conductive, the combined thickness of the metal oxide layer and the electrode layer is preferably in the range of 50 nm to 1 μm.

A large plate-like piezoelectric element prepared as described above can be processed into a desired size by the dicing method, the blast method or any other well-known processing method to be used for such a purpose as manufacturing a liquid droplet ejection head.

When the piezoelectric element according to the present embodiment is used only for manufacturing a liquid droplet ejection head having a diaphragm, the piezoelectric element may be formed by film-forming the respective layers constituting the piezoelectric element in sequence for lamination on the substrate to provide the diaphragm with the use of the vapor phase film formation method as exemplified above.

Next, a liquid droplet ejection head according to the present embodiment will be described. The liquid droplet ejection head is not limited, provided that it can eject liquid droplets from the liquid droplet ejection port (nozzle) by using the piezoelectric element; however, it is preferable that the liquid droplet ejection head has the following configuration.

The liquid droplet ejection head according to the present embodiment preferably has a pressure generating chamber which is filled with liquid; a liquid droplet ejection port which is connected to the pressure generating chamber and is capable of ejecting ink liquid droplets; a diaphragm which constitutes at least a part of the wall surface of the pressure generating chamber, and dilates and contracts the pressure generating chamber by vibrating; and an actuator including at least a piezoelectric element which vibrates the diaphragm, being deformed by the voltage applied in accordance with the image information. The liquid droplet ejection apparatus according to the present embodiment is not limited, provided that it comprises a liquid droplet ejection head.

Hereinafter, a specific example of the liquid droplet ejection head according to the present embodiment will be described in detail with reference to FIG. 1 and FIG. 2.

The liquid droplet ejection head 112 according to the present embodiment is a so-called line-type liquid droplet ejection head 112 in which a number of liquid droplet ejection ports 152 (see FIG. 2) for ejecting ink liquid droplets are disposed over the width corresponding to the overall width in the widthwise direction of the recording medium, such as a paper, and for the respective liquid droplet ejection ports 152, a piezoelectric element 144 for causing liquid droplets to be ejected is disposed, the total number of piezoelectric elements 144 being equal to that of liquid droplet ejection ports 152.

Thus, in the liquid droplet ejection head 112 according to the present embodiment, a number of liquid droplet ejection ports 152 are provided across the width corresponding to the size of width of the recording medium, and with a liquid droplet ejection apparatus, such as an ink jet printer, using the liquid droplet ejection head 112, at least one of the liquid droplet ejection head 112 and the recording medium is relatively moved in the direction orthogonal to the widthwise direction of the recording medium, during recording of an image with ink.

FIG. 1 partially shows the surface on which the piezoelectric elements 144 of the liquid droplet ejection head 112 are disposed, and on the reverse face side of the liquid droplet ejection head 112, the ejection ports 152 (see FIG. 2) are provided, each one of the liquid droplet ejection ports 152 being provided to one piezoelectric element 144. In this liquid droplet ejection head 112, a number of columns of piezoelectric elements 144 are two-dimensionally provided along the widthwise direction of the recording medium, four rows of piezoelectric elements 144 being provided along the direction orthogonal to the widthwise direction of the recording medium. In FIG. 1, among the number of columns of piezoelectric elements 144 disposed along the widthwise direction of the recording medium, only four columns are shown. The four rows of piezoelectric elements 144 are provided along the direction orthogonal to the widthwise direction of the recording medium in order to increase the recording speed by causing four rows of ink liquid droplets to be ejected onto the recording medium at one time.

Figure 2:
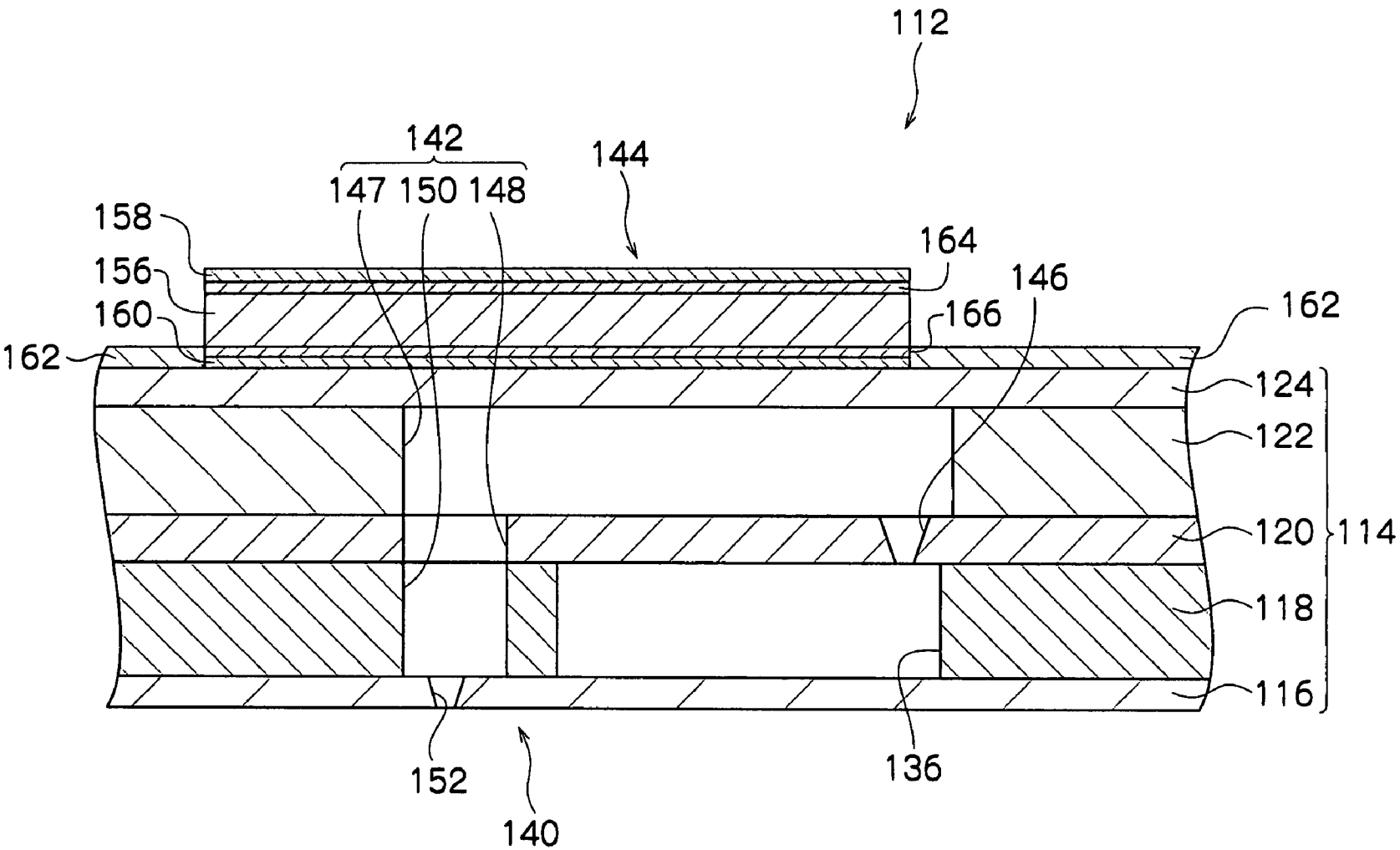
FIG. 2 is a section taken on line A-A in FIG. 1.

FIG. 2 is a sectional view of line A-A in FIG. 1. Although FIG. 2 shows a section of only one piezoelectric element 144 in the liquid droplet ejection head 112, the sectional view is the same for all of the other piezoelectric elements 144.

As shown in FIG. 2, the liquid droplet ejection head 112 has a laminated flow path plate 114. The laminated flow path plate 114 is formed by registering and laminating a nozzle plate 116, a flow path plate 118, a supply path plate 120, a pressure generating chamber plate 122, and a diaphragm 124, in this order from the lowest layer, five plates in total, and joining these by means of a joint, such as an adhesive.

In the nozzle plate 116, the liquid droplet ejection port 152 is formed; in the pressure generating chamber plate 122, the supply path plate 120, and the flow path plate 118, short holes 147, 148, 150 are provided for each location of the liquid droplet ejection port 152; and the short holes 147, 148, 150 constitute a pressure generating chamber 142 for each liquid droplet ejection port 152, individually.

Further, in the flow path plate 118, an elongated hole 136 (refer to the imaginary lines in FIG. 1) is formed along the widthwise direction of the recording medium for supplying ink to the respective pressure generating chambers 142, the elongated hole 136 being connected to the respective pressure generating chambers 142 through an ink supplying hole 146. As shown in FIG. 1, in the liquid droplet ejection head 112, four rows of piezoelectric elements are provided along the widthwise direction of the recording medium, thus, four elongated holes 136 are formed along the direction orthogonal to the widthwise direction of the recording medium. To the respective elongated holes 136, an ink supplying apparatus (not shown) is connected, and the ink supplied from the ink supplying apparatus to the elongated hole 136 is caused to fill the respective pressure generating chambers 142 through the ink supplying hole 146.

To the diaphragm 124, the piezoelectric element 144 is attached, corresponding to the respective pressure generating chambers 142. As shown in FIG. 2, the piezoelectric element 144 is configured to comprise a piezoelectric body (layer) 156, metal oxide layers 164, 166 provided on both end surfaces of the piezoelectric body 156 in the thickness direction, and further an electrode layer 158, 160 provided on the face of the metal oxide layer 164, 166 on the side opposite to the side facing the piezoelectric body 156.

In the present embodiment, description is given using the piezoelectric element 144 having a configuration in which the metal oxide layers 164, 166 are made of an electrically non-conductive material, and the electrode layers 158, 160 are formed in film on the metal oxide layers 164, 166. However, as described above, when the metal oxide layers 164, 166 are made up of an electrically conductive material, the metal oxide layers 164, 166 can also function as an electrode, and thus the electrode layers 158, 160 can be eliminated.

When a drive voltage waveform in accordance with the image information is applied to this piezoelectric element 144, the piezoelectric element 144 is deformed to vibrate the diaphragm 124, which causes the pressure generating chamber 142 to dilate and contract. Thereby, changes in volume are produced in the pressure generating chamber 142, resulting in a pressure wave being created in the pressure generating chamber 142. By the action of this pressure wave, the ink which is filled up in the pressure generating chamber 142 is ejected from the liquid droplet ejection port 152 to the outside. Especially, in the present embodiment, one piezoelectric element 144 is provided for each of the pressure generating chambers 142, as described above, and thus, the piezoelectric element 144 is individualized, being separately provided for the respective pressure generating chambers 142. Therefore, the respective piezoelectric elements 144 can provide respective piezoelectric characteristics, being unaffected by the adjacent piezoelectric elements 144.

Figure 3:
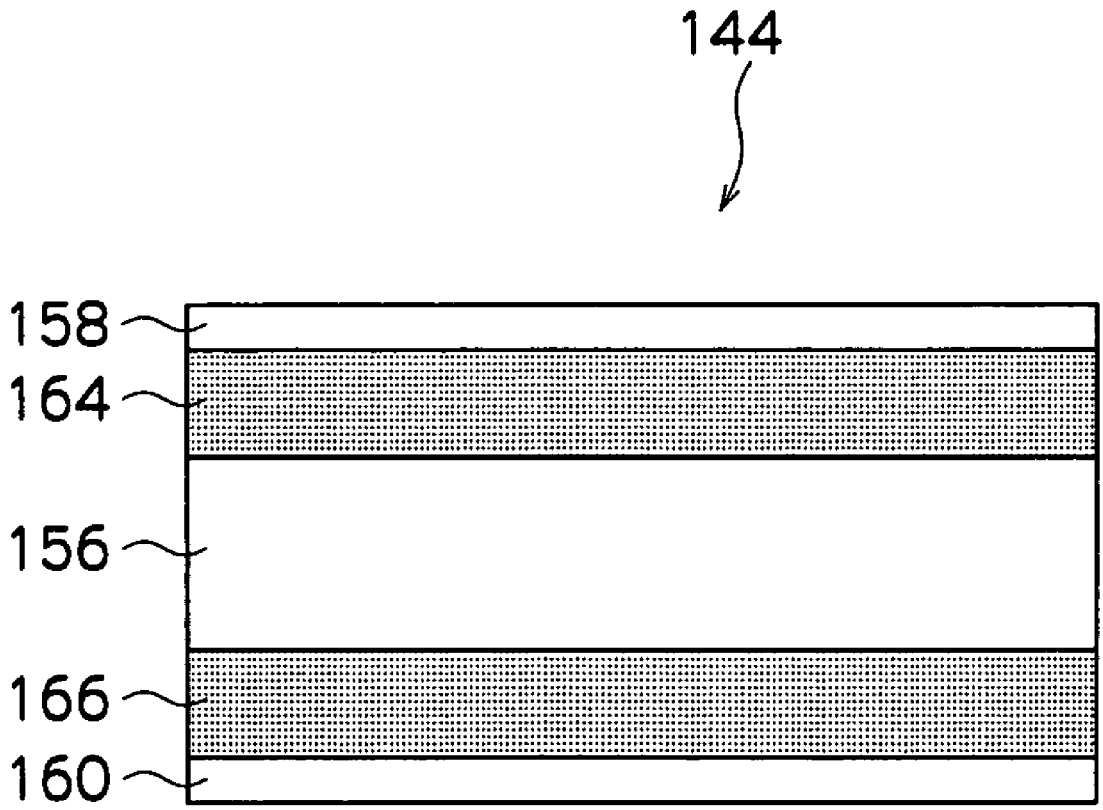
FIG. 3 is a sectional view (enlarged view) of a piezoelectric element according to the present embodiment.

Herein, the manufacturing method for the piezoelectric element 144 and the liquid droplet ejection head 112 according to the present embodiment will be described by using a specific example of material and the like with reference to FIG. 2 and FIG. 3. (FIG. 3 is an enlarged view of the piezoelectric element 144 shown in FIG. 2.)

(1) First, on the face on the diaphragm 124 side of the piezoelectric body 156 made of PZT that is processed to the required thickness (30 μm, for example), a tin oxide film, for example, is formed as the metal oxide layer 166. In this case, the sputtering method is used with a tin oxide target or the reactive sputtering method is employed with a tin target. Then, when the formed metal oxide layer 166 is made of an electrically non-conductive material, an electrode layer 160 is formed in film on the face of the metal oxide layer 166 that is facing away from the piezoelectric body 156. This electrode layer 160 is constituted by two layers, i.e., a Ni layer and an Au layer, for example, the Ni layer being formed in film by the sputtering method with a Ni target, and the Au layer being formed in film by the sequential sputtering method with an Au target for formation of the electrode layer 160 (hereafter called a second electrode layer).

(2) Next, on the face of the piezoelectric body 156, which is opposite to the face on which the metal oxide layer 166 is formed, a tin oxide film, for example, is formed as the metal oxide layer 164, in the same manner as described above. Then, when the formed metal oxide layer 164 is made of an electrically non-conductive material, an electrode layer 158 is formed in film on the metal oxide layer 164. In order to facilitate the wiring, this electrode layer 158 is constituted by two layers, i.e., a Ni layer and an Au layer, for example, the Ni layer and the Au layer being sequentially laminated by the sputtering method with a Ni target and an Au target, respectively, for forming the electrode layer 158 (hereafter called a first electrode layer) in the same manner as described above.

(3) The laminated body configured as described above is individualized to complete the piezoelectric element 144 by using a blast method, a dicing method, or the like so as to provide a geometry corresponding to the respective pressure generating chambers 142 and a construction with which the respective layers of the laminated body are exposed.

(4) Next, by means of the adhesive 162 (see FIG. 2), the completed piezoelectric element 144 is bonded to the diaphragm 124 in the laminated flow path plate 114 (see FIG. 2) with which plural plates are previously laminated, for constructing a piezo-actuator with the piezoelectric element 144 and the diaphragm 124.

(5) To each of the first electrode layer 158 and the second electrode layer 160 of the piezoelectric element 144, a flexible cable is connected through an electric contact, such as a solder joint.

With the piezoelectric element 144 according to the present embodiment, the first electrode layer 158 and the second electrode layer 160 are isolated for each piezoelectric element 144, as shown in FIG. 2. However, only the first electrode layer 158 may be isolated, while the second electrode layer 160 may be formed such that it is connected as an integral part to the face of the laminated flow path plate 114.

In this way, the liquid droplet ejection head 112 according to the present embodiment is configured. However, the manufacturing method for the piezoelectric element 144 and the liquid droplet ejection head 112 is not limited to the method as described above, and modification, improvement, amendment, and simplification may, of course, be applied to the above method.

Incidentally, as an example, assuming that the metal oxide layers 164, 164 are removed from the piezoelectric element 144 according to the present embodiment for providing a conventional piezoelectric element, periodically applying a voltage at a higher potential to the first electrode layer 158, and a voltage at a lower potential to the second electrode layer 160 for driving the conventional piezoelectric element may degrade the piezoelectric characteristic of the piezoelectric body 156. Such degradation of the piezoelectric characteristic is caused by generation of oxygen vacancies in the piezoelectric body 156, and this generation of oxygen vacancies, as described above, results from moisture being electrolyzed by the synergistic effect of the electric field and the electric current due to application of the voltage, and then entering the piezoelectric body 156 in the form of ions to deoxidize the material constituting the piezoelectric body 156.

Figures 4A, 4B:
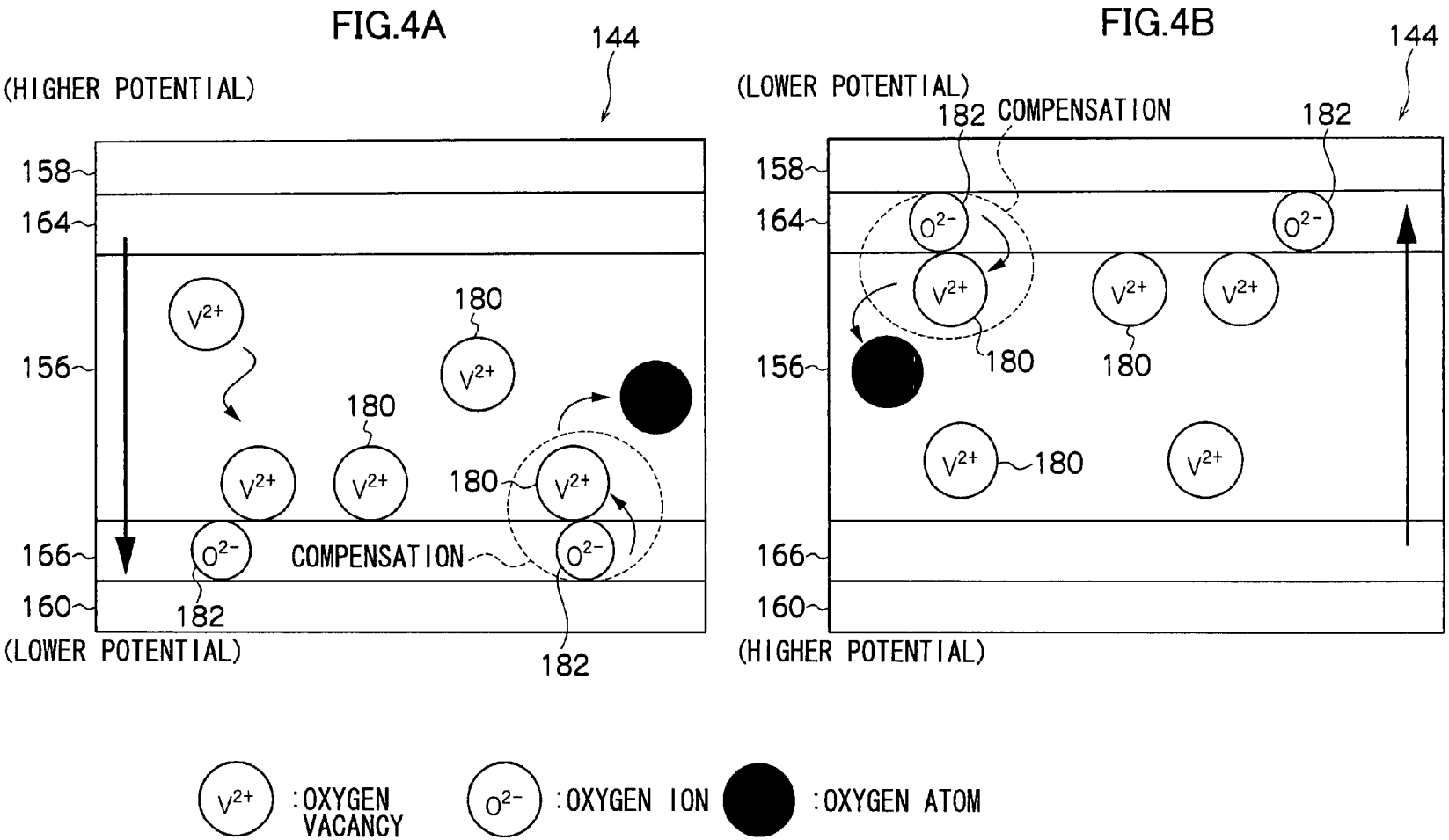
FIG. 4A is a conceptual drawing provided for illustrating the oxygen vacancies of a piezoelectric element according to the present embodiment, and the compensation.
FIG. 4B is a conceptual drawing provided for illustrating the oxygen vacancies of a piezoelectric element according to the present embodiment, and the compensation.

In contrast, with the piezoelectric element 144 according to the present embodiment, as shown in FIG. 4A, oxygen vacancies 180 generated in the piezoelectric body 156 can be compensated for and canceled by oxygen ions 182 supplied from the metal oxide layer 166 provided adjacent to the face on the lower potential application side of the piezoelectric body 156. However, since the compensation by the metal oxide layer 166 is limited, some of the oxygen vacancies 180 are accumulated, and are not compensated. If oxygen vacancies 180 are accumulated, the electrical characteristic of the piezoelectric body 156 is changed, and the piezoelectric characteristic is also degraded.

Therefore, with the liquid droplet ejection apparatus according to the present embodiment, capacitance is detected as the electrical characteristic of the piezoelectric body 156, and the detected capacitance is compared with the capacitance in the initial state (the state as manufactured) to detect the level of degradation of the piezoelectric characteristic by the accumulation of oxygen vacancies 180. When the change in capacitance exceeds a predetermined range, the lower potential is applied to the first electrode layer 158 and the higher potential is applied to the second electrode layer 160, contrarily to the way when ink liquid droplets are normally ejected, as shown in FIG. 4B, as an example, in order to generate the reverse electric field for carrying out compensation of the accumulated oxygen vacancies 180 by means of the metal oxide layer 164 to correct for the degradation of the piezoelectric element 144.

With the liquid droplet ejection apparatus according to the present embodiment, the level of the degradation of the piezoelectric characteristic due to the accumulation of oxygen vacancies 180 is detected by the change in the capacitance of the piezoelectric element 144. However, when an electrical characteristic other than capacitance, such as resistance, is changed by the accumulation of oxygen vacancies, that electrical characteristic can be used to detect the degradation level.

Herein, assuming that the capacitance of the piezoelectric element 144 is 500 pF, for example, the current flowing when a voltage of a predetermined frequency (1 kHz, for example) is applied across the first electrode layer 158 and the second electrode layer 160 of the respective piezoelectric elements 144 is approximately constant, its value depending upon the capacitance of the piezoelectric element 144. However, with the piezoelectric element 144 in which oxygen vacancies 180 are accumulated, the capacitance is reduced, thus, the amount of current flowing when the voltage of a predetermined frequency (1 kHz, for example) is applied is reduced. Therefore, by detecting a capacitance from the amount of current across the first electrode layer 158 and the second electrode layer 160 of the respective piezoelectric elements 144, and comparing it with the capacitance in the initial state (the state as manufactured) to determine the percentage of change in the capacitance, the degradation level of the piezoelectric element 144 can be detected.

Figure 5:
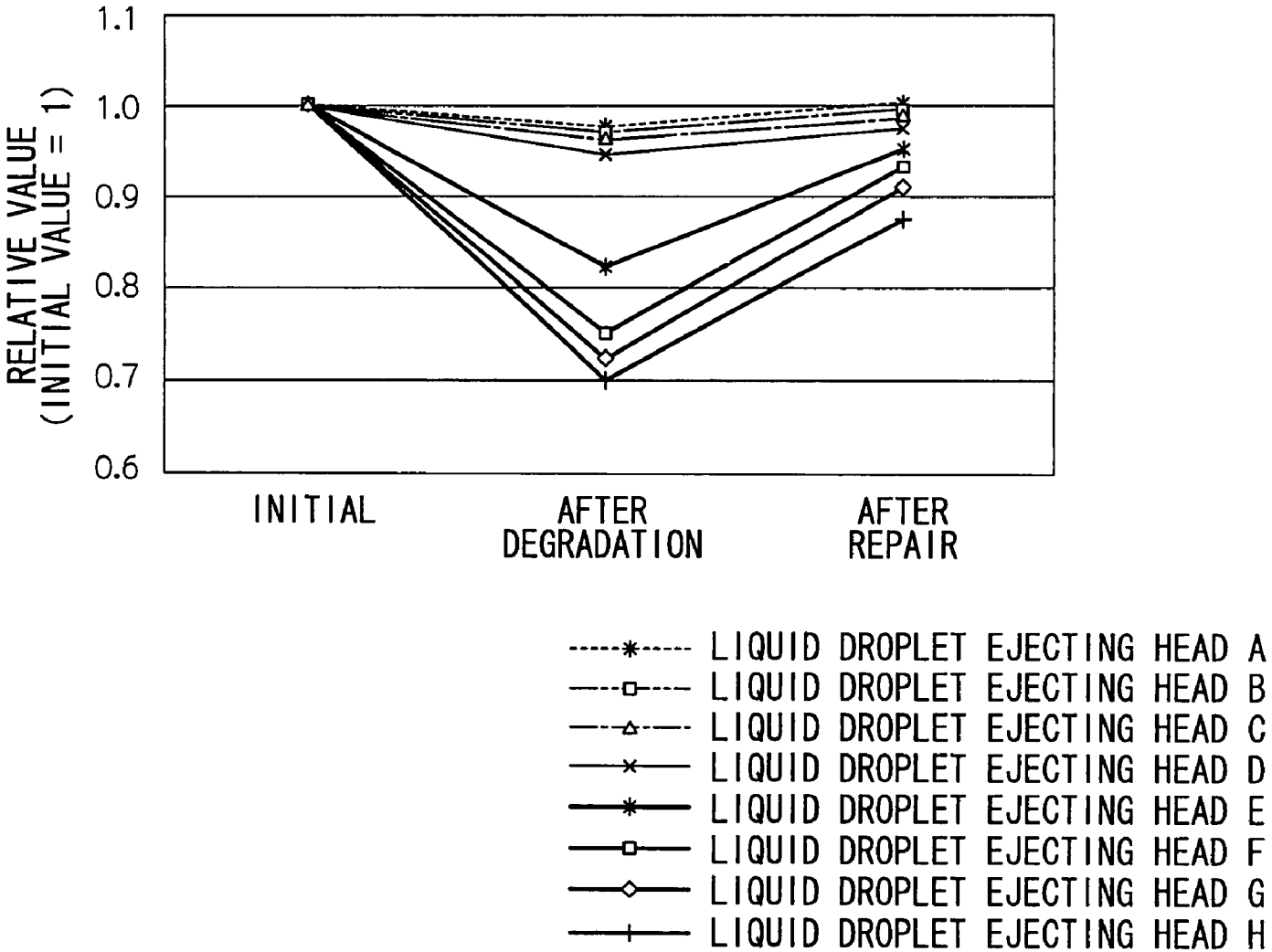
FIG. 5 is a graph provided for illustrating the effect when the compensation is carried out for a degraded piezoelectric element according to the present embodiment.

FIG. 5 shows the results of the correction which was carried out by switching over the voltage applied across the first electrode layer 158 and the second electrode layer 160 to generate the reverse electric field in the respective piezoelectric elements 144 in plural liquid droplet ejection heads 112 (liquid droplet ejection heads A to H) after usage for a predetermined period of time. As shown in FIG. 5, by applying a voltage of the reverse electric field to the degraded piezoelectric elements 144 to compensate for the accumulated oxygen vacancies, degradation of the piezoelectric elements 144 is repaired to some degree.

Especially when the percentage as a result of comparison between the capacitance of the piezoelectric element 144 in the liquid droplet ejection head in the initial state and the capacitance of the piezoelectric element 144 in the liquid droplet ejection head after usage for a predetermined period of time is 97% or higher (the degradation level is 3% or lower), the degradation can be repaired substantially to recover to the initial state. Therefore, in the piezoelectric element repair process to be described later, when the degradation level is equal to or higher than a predetermined level (for example, 3%), a voltage of the reverse electric field is applied to the piezoelectric element 144 for repair.

Figure 6:
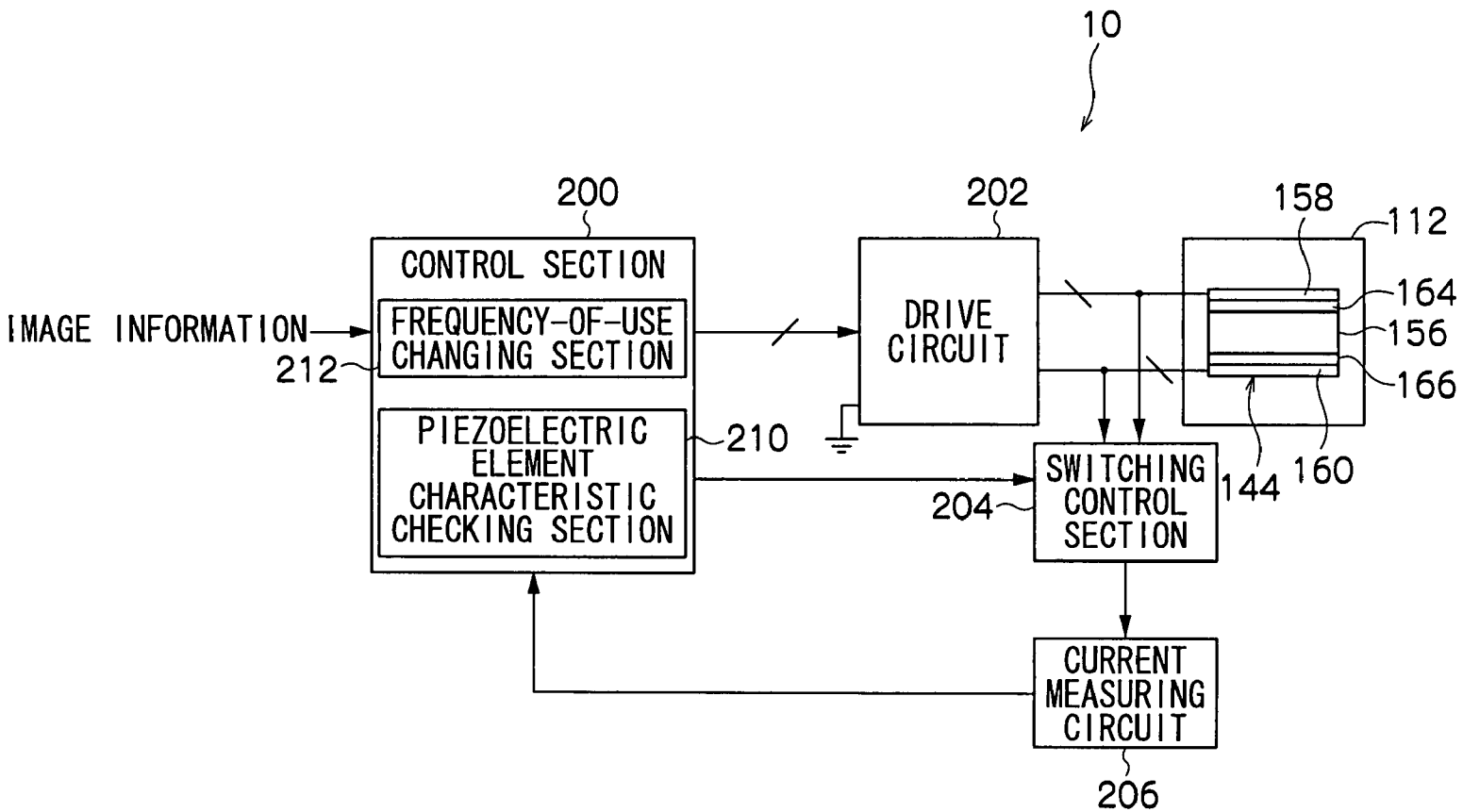
FIG. 6 is a block diagram illustrating the configuration of the critical components of a liquid droplet ejection apparatus according to the present embodiment.

Next, the configuration of the critical portion of a liquid droplet ejection apparatus 10 to which the liquid droplet ejection head 112 is applied will be described with reference to FIG. 6. In FIG. 6, only one piezoelectric element 144 provided in the liquid droplet ejection head 112 is shown in order to avoid complexity.

The liquid droplet ejection apparatus 10 according to the present embodiment comprises a control section 200 which controls the operation of the entire liquid droplet ejection apparatus 10, and a drive circuit 202 which is provided between the control section 200 and the liquid droplet ejection head 112.

Herein, to the control section 200 according to the present embodiment, image information indicating an image to be formed by the liquid droplet ejection head 112 is inputted. When the image information is inputted, the control section 200 controls a recording medium moving section (not shown) to move a recording medium (not shown) in the direction orthogonal to the widthwise direction of the recording medium. Then, on the basis of the image information inputted, the control section 200 outputs, to the drive circuit 202, a drive signal for applying a voltage to the respective piezoelectric elements 144 provided in the liquid droplet ejection head 112 such that the image indicated by the image information is formed on a paper in cooperation with the paper movement operation by the recording medium moving section.

The drive circuit 202 is connected to the first electrode layer 158 and the second electrode layer 160 of the respective piezoelectric elements 144, respectively, by means of a flexible cable and further connected to a power supply (not shown) and the ground level (a wiring grounded).

The drive circuit 202 applies a voltage of a predetermined frequency to the first electrode layer 158 of the piezoelectric element 144 specified to be driven by the drive signal inputted from the control section 200, and sets the potential of the second electrode layer 160 at a ground level. Thereby, the piezoelectric element 144 specified to be driven is vibrated, thus ink liquid droplets are ejected from the liquid droplet ejection port 152, and as a result, the image indicated by the image information is formed on the recording medium. With the liquid droplet ejection apparatus 10 according to the present embodiment, the voltage to be applied to the first electrode layer 158 is defined to be 1 V, for example, for a thickness of 1 μm of the piezoelectric body 156. Therefore, since the piezoelectric body 156 has a thickness of 30 μm, a voltage of 30 V is applied. Further, with the present embodiment, the predetermined frequency is predetermined as a frequency which can deform the piezoelectric body 156 in response to the application of the voltage, being defined to be a several ten kHz or so, for example. With the present embodiment, the above-mentioned voltage of 30 V is applied to the first electrode layer 158 for providing a potential higher than the second electrode layer 160, the potential difference being defined to be 30 V. However, the potential of the first electrode layer 158 may be set at the ground level, and to the second electrode layer 160, a voltage of −30 V, for example, may be applied for providing a potential difference of 30 V. Alternatively, different voltages (including voltages with different polarities) may be applied to the first electrode layer 158 and the second electrode layer 160 for generating a potential difference.

Herein, as described above, the piezoelectric element 144 functions such that oxygen vacancies 180 generating in the piezoelectric body 156 due to the drive signaling are compensated for and canceled by oxygen ions 182 supplied from the metal oxide layer 166 provided adjacent to the face on the lower potential application side of the piezoelectric body 156. However, some of the oxygen vacancies 180 are accumulated and are not compensated.

The control section 200 carries out the piezoelectric element repair process in which the degradation level of the respective piezoelectric elements 144 in the liquid droplet ejection head 112 is detected during the period when no drive signal based on the image information is outputted, and as a result of this detection, the oxygen vacancies 180 are compensated for and canceled.

On the other hand, the liquid droplet ejection apparatus 10 according to the present embodiment is provided with a switching control section 204 which selectively and electrically connects the first electrode layer 158 and the second electrode layer 160 of any particular piezoelectric element 144 provided in the liquid droplet ejection head 112 to a current measuring circuit 206 to be described later.

Further, the liquid droplet ejection apparatus 10 according to the present embodiment is provided with a current measuring circuit 206 which measures the level of the current flowing between two points electrically connected to each other, and outputs a current level signal indicating the level of current.

The switching control section 204 is connected to the control section 200 and the current measuring circuit 206. Selection of a particular piezoelectric element 144 by the switching control section 204 is controlled by the control section 200, and the first electrode layer 158 and the second electrode layer 160 of the piezoelectric element 144 selected thereby are connected to the current measuring circuit 206.

The output terminal of the current measuring circuit 206 that outputs the current level signal is connected to the control section 200. Therefore, the control section 200 controls the drive circuit 202 such that a predetermined voltage is applied across the first electrode layer 158 and the second electrode layer 160 of the piezoelectric element 144 selected by itself, and controls the switching control section 204 such that the first electrode layer 158 and the second electrode layer 160 of the piezoelectric element 144 selected are connected to the current measuring circuit 206, whereby the control section 200 is capable of detecting the capacitance based on the level of current flowing across the first electrode layer 158 and the second electrode layer 160 of the piezoelectric element 144 selected by itself.

On the other hand, the control section 200 is provided with a piezoelectric element characteristic checking section 210, in which the value of the capacitance of the piezoelectric element 144 in the non-degraded initial state (the state as manufactured) is stored. The piezoelectric element characteristic checking section 210 detects the degree of degradation (hereafter called degradation level) of the piezoelectric element 144 by comparing the capacitance of the piezoelectric element 144 that has been detected based on the level of the current, with the capacitance thereof in the initial state.

Further, when the degradation level obtained from comparison by the piezoelectric element characteristic checking section 210 is at a predetermined level (for example, 3%) or higher, the control section 200 outputs a repair instruction signal for instructing repair of the piezoelectric element 144 to the drive circuit 202 in order to carrying out repair of the piezoelectric element 144.

The drive circuit 202 applies a voltage at a frequency (several hundred kHz) higher than a predetermined frequency (several ten kHz) when ink liquid droplets are caused to be ejected, to the piezoelectric element 144 specified by the repair instruction signal such that an electric field in the direction, which is reverse to that when ink liquid droplets are caused to be ejected, is formed. Herein, the frequency higher than the predetermined frequency is a frequency at which the piezoelectric body 156 of the piezoelectric element 144 will not be deformed in response to the applied voltage, and which is higher than that when ink liquid droplets are caused to be ejected. Therefore, even if the voltage of the frequency is applied, a pressure wave which can cause ink liquid droplets to be ejected is not generated in the pressure generating chamber 142, and thus no ink liquid droplets will be ejected from the liquid droplet ejection port 152.

Further, herein, the voltage to be applied is defined to be 0.2 V, for example, for a thickness of 1 μm of the piezoelectric body 156. With the present embodiment, the thickness of the piezoelectric body 156 is 30 μm, thus the voltage to be applied is 6 V. Thereby, the predetermined amount of deformation of the piezoelectric body 156 is reduced, and thus ink liquid droplets being ejected from the liquid droplet ejection port 152 can be prevented.

When the drive circuit 202 according to the present embodiment receives a repair instruction signal, it applies a voltage which value is lower than that when it causes ink liquid droplets to be ejected, and which frequency is higher than that when it causes ink liquid droplets to be ejected. However, a voltage which satisfies only one of these conditions may be applied.

On the other hand, the control section 200 is further provided with a frequency-of-use changing section 212 which stores the frequency of use of the respective piezoelectric elements 144. The control section 200 detects the capacitance of the piezoelectric element 144 for which a repair instruction signal has been outputted to carry out correction for the degradation, and lowers the frequency of use if the piezoelectric element 144 has been degraded to or over the above-mentioned predetermined level.

Next, as an operation of the present embodiment, the operation of the liquid droplet ejection apparatus 10 when the piezoelectric element repair process, which is especially related to the present invention, is executed, will be described with reference to FIG. 7.

Figure 7:
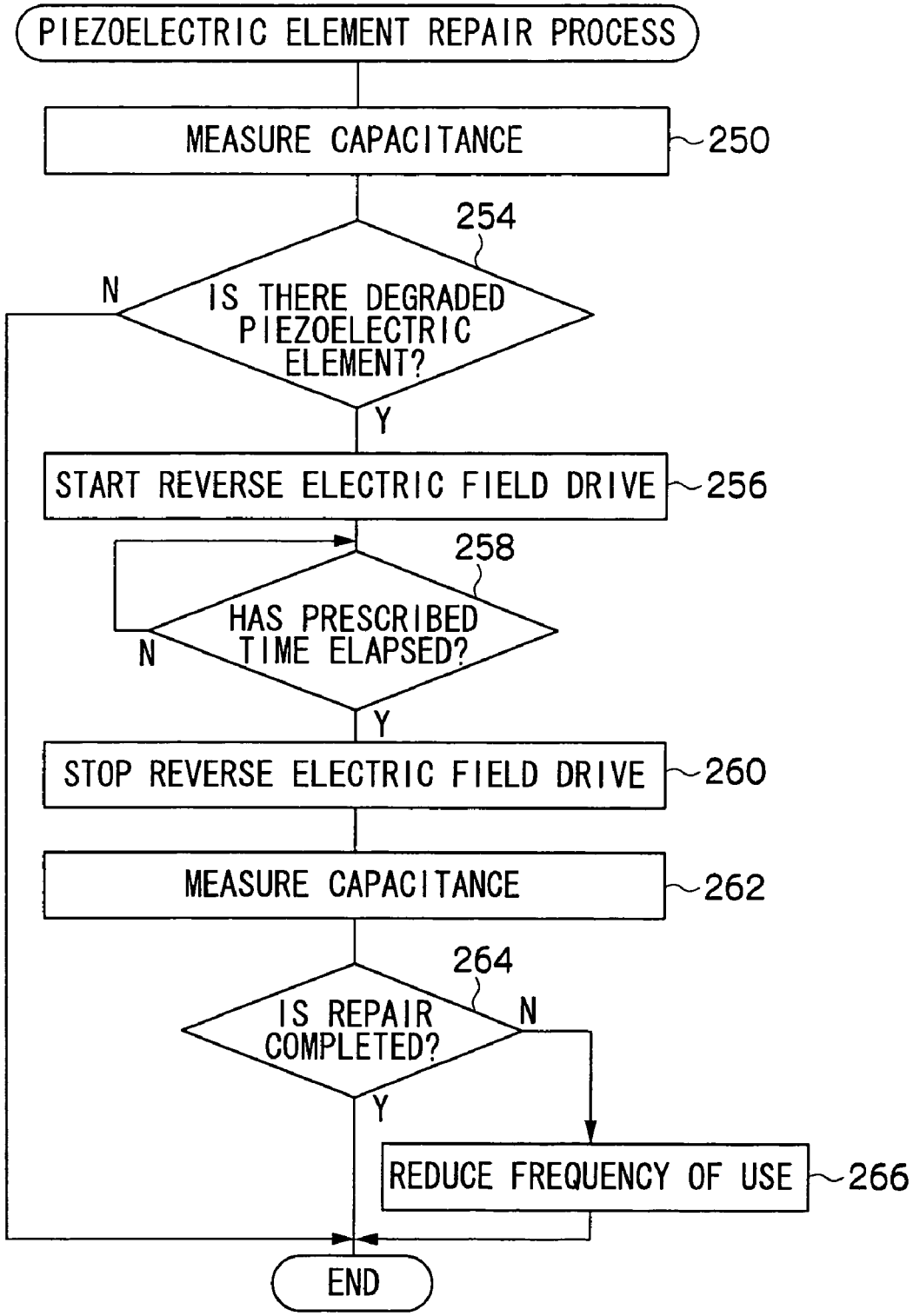
FIG. 7 is a flow chart illustrating the flow of processing the piezoelectric element repair program according to the present embodiment.

FIG. 7 is a flow chart illustrating the flow of processing the piezoelectric element repair program which is implemented by the control section 200 when the piezoelectric element repair process is executed.

First, in step 250 in FIG. 7, the drive circuit 202 and the switching control section 204 are controlled such that the current level across the first electrode layer 158 and the second electrode layer 160 of the respective piezoelectric elements 144 in the liquid droplet ejection head 112 is detected. Thereby, the capacitance is detected from the current level detected.

In the next step 254, it is determined whether, among the capacitances of the respective piezoelectric elements 144 that have been detected, there is a value of capacitance that has been lowered by the predetermined value or more from the capacitance in the initial state (the state as manufactured) previously stored; if a negative determination is given, the piezoelectric element repair program is terminated; and if an affirmative determination is given, the program will proceed to step 256.

In other words, with the piezoelectric element repair program according to the present embodiment, the oxygen vacancies are detected based on the decrease in the capacitance of the piezoelectric element 144. In this case, it is preferable that the above-mentioned predetermined value used as a threshold value is 3% of the capacitance in the initial state based on the predetermined level as described with reference to FIG. 5. For example, if the capacitance in the initial state is 500 pF, the predetermined value is 500 pF×3%=15 pF, thus it is determined whether there is a detected piezoelectric element 144 whose capacitance has been lowered by 15 pF or over from the capacitance of 500 pF in the initial state (i.e., down to 485 pF or under).

In the next step 256, a repair instruction signal for instructing correction for the degradation of the piezoelectric element 144, which has been determined to have oxygen vacancies 180 accumulated therein, resulting in a degradation being caused, is outputted to the drive circuit 202. By applying the voltages to the first electrode layer 158 and the second electrode layer 160 with the polarities which are reverse to those when ink liquid droplets are ejected (when an image is formed), generation of the reverse electric field is started for starting the compensation for the oxygen vacancies 180 accumulated, and at the next step 258, the lapse of the predetermined period of time is waited for.

With the present embodiment, as the above-mentioned predetermined period of time, a time period acquired in advance by an experiment using an actual machine of the liquid droplet ejection apparatus 10 or a computer simulation or the like on the basis of the design specifications for the liquid droplet ejection apparatus 10 and the liquid droplet ejection head 112, may be applied as a time period which allows the oxygen vacancies 180 accumulated in the piezoelectric element 144 to be compensated for as much as possible when the reverse electric field is applied.

In the next step 260, the output of the repair instruction signal which caused the drive circuit 202 to start the output in the above step 256 is stopped to stop the application of the reverse electric field, and in the next step 262, the process for detecting the capacitance from the current level across the first electrode layer 158 and the second electrode layer 160 of the respective piezoelectric elements 144 is carried out again.

In the next step 264, by determining whether the degradation level which can be found from the capacitance (the electrical characteristic) detected is under a predetermined level (for example, 3%), it is determined whether the degradation of the piezoelectric element 144 has been sufficiently corrected. If an affirmative determination is given, the piezoelectric element repair program is terminated; and if a negative determination is given, the program will proceed to step 266 to carry out the setting for reducing the frequency of use of the pertinent piezoelectric element 144 to suppress the progress of degradation of the pertinent piezoelectric element 144 before terminating the piezoelectric element repair program.

Thus, according to the present embodiment, the first metal oxide layer (herein, the metal oxide layer 166) is disposed adjacent to the piezoelectric body layer (herein, the piezoelectric body 156) on the lower voltage side when an electric field in the predetermined direction is applied to the piezoelectric body layer which is deformed by the electric field being applied. The first metal oxide layer suppresses the degradation of the piezoelectric body layer that is caused by the application of the electric field, while the second metal oxide layer (herein, the metal oxide layer 164) is disposed adjacent to the piezoelectric body layer on the higher voltage side of the electric field applied to the piezoelectric body layer, and repairs the piezoelectric body layer degraded, by applying an electric field in the direction reverse to the electric field. Thus the degradation of the piezoelectric characteristic of the piezoelectric element 144 can be repaired.

Further, at least one of the first metal oxide layer and the second metal oxide layer is made up of an electrically non-conductive material, and on the side opposite to the side facing the piezoelectric body layer of the first metal oxide layer or the second metal oxide layer made up of an electrically non-conductive material, an electrode layer (herein, the first electrode layer 158 or the second electrode layer 160) made of a metal or an electrically conductive metal oxide is further provided, and thus an electrically non-conductive material can be applied to the first metal oxide layer or the second metal oxide layer.

When the first metal oxide layer or the second metal oxide layer is conductive, it is unnecessary to provide the first electrode layer 158 or the second electrode layer 160, respectively.

Further, the first metal oxide layer or the second metal oxide layer can be made up of a material containing at least one of iridium, tin, ruthenium, rhenium, rhodium, palladium, strontium, indium, titanium, zirconium, niobium, magnesium, silicon, tantalum, aluminum, zinc, manganese, cobalt, osmium, and hafnium, and thus the oxygen vacancies 180 can be compensated for by the oxygen ions 182.

Further, the liquid droplet ejection head 112 comprises a plurality of piezoelectric elements according to the present invention, and thus the degradation of the piezoelectric characteristic can be repaired along with the effects of the piezoelectric element as described above.

Further, the electric field application section (herein, the drive circuit 202) applies an electric field to the piezoelectric element 144 which is provided in the liquid droplet ejection head 112; the degradation detection section (herein, the piezoelectric element characteristic checking section 210) detects the level of degradation of the piezoelectric element 144 due to the accumulation of oxygen vacancies; and the control section (herein, the control section 200) controls the electric field application section such that, when the degradation level detected by the degradation detection section is under the predetermined level and the ink liquid droplets are caused to be ejected, an electric field in the predetermined direction is applied to the piezoelectric element, and when the degradation level detected by the degradation detection section is equal to or over the predetermined level, an electric field in the direction reverse to the predetermined direction is applied to the piezoelectric element, and thus the degradation of the piezoelectric characteristic can be repaired.

Further, on the basis of the change in the electrical characteristic of the piezoelectric element 144, the degradation detection section detects the level of degradation of the pertinent piezoelectric element due to the accumulation of oxygen vacancies, thus the oxygen vacancies can be easily detected.

Further, when the electric field application section applies an electric field in the direction reverse to the predetermined direction, it applies, to the piezoelectric element in the direction reverse to the predetermined direction, a voltage whose value is lower than the predetermined voltage which is applied to the piezoelectric element 144 when the electric field is applied in the predetermined direction, and whose frequency is higher than the predetermined frequency which is applied to the piezoelectric element 144 in the direction reverse to the predetermined direction, and thus when the reverse electric field is applied, ink liquid droplets being ejected can be prevented.

(Modification)

Figure 8:
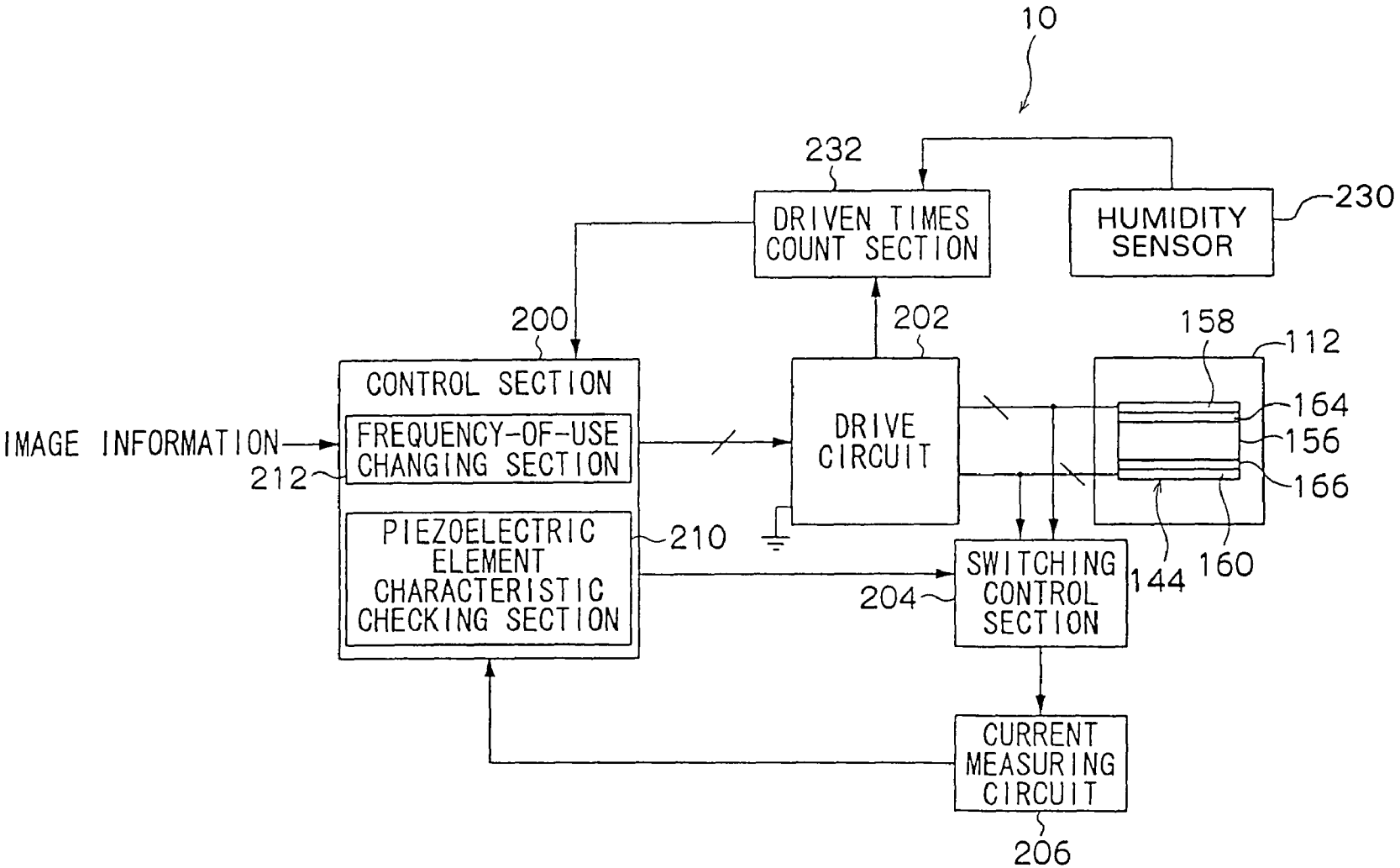
FIG. 8 is a block diagram illustrating the configuration of the critical components of a liquid droplet ejection apparatus according to the present embodiment.

Next, a modification of the present embodiment will be described with reference to FIG. 8. In FIG. 8, the portions having the same signs as FIG. 6 are the same as those in FIG. 6, and thus description thereof is omitted, and the portions newly added will be described with new signs being attached thereto.

In the above embodiment, the degradation caused by the oxygen vacancies 180 is detected based on the capacitance of the respective piezoelectric elements 144. However, the feature of the present modification is that the degradation is corrected for, by counting the number of times a particular piezoelectric element is driven in a high-humidity environment, with the use of a humidity sensor 230 and a driven times count section 232.

Since oxygen vacancies 180 are generated in large amount at a high humidity (70% or higher), the humidity sensor 230 is disposed in the vicinity of the liquid droplet ejection head 112 in the present modification.

The humidity sensor 230 detects the humidity of the atmosphere in the vicinity of the liquid droplet ejection head 112, and outputs a humidity signal to the driven times count section 232.

When the humidity sensor 230 detects high humidity of the atmosphere in the vicinity of the liquid droplet ejection head 112, the driven times count section 232 counts the number of times the drive signal has been outputted from the control section 200 to the drive circuit 202. The driven times count section 232 incorporates a timer (not shown) therein, and when the number of counts equal to or over the predetermined number (10,000,000) is detected within a predetermined period of time (10 minutes for example), a repair start signal is outputted to the control section 200.

When the control section 200 receives the repair start signal, it outputs a repair instruction signal to all the piezoelectric elements 144 in sequence for carrying out compensation for the oxygen vacancies 180 accumulated in the piezoelectric elements 144 in the same manner as step 256 and subsequent for the piezoelectric element repair process in the embodiment.

Thus, according to the present modification, when the liquid droplet ejection apparatus 10 is frequently used in a high-humidity environment, oxygen vacancies 180 are accumulated in the piezoelectric elements 144, resulting in faster degradation. Thus, the number of driven times during the predetermined time period is counted, and when the drive signal is detected the predetermined number of times or more, the reverse electric field is applied to the piezoelectric elements 144, which provides the proper timing to carry out the repair process for the piezoelectric elements 144.

Therefore, without having to carry out detection of the degradation level of the respective piezoelectric elements 144 as in the embodiment, the piezoelectric element repair process can be carried out at a proper timing.

What is claimed is:

1. A piezoelectric element recovery apparatus comprising:

a piezoelectric element comprising:

a single piezoelectric body layer which is deformed by an applied electric field;

a first metal oxide layer which is disposed directly adjacent to the piezoelectric body layer on the lower potential side when an electric field in a predetermined direction is applied to the piezoelectric body layer, and which suppresses degradation of the piezoelectric body layer that is caused by application of the electric field, the first metal oxide layer contacting an outer face of the piezoelectric body layer; and a second metal oxide layer which is disposed directly adjacent to the piezoelectric body layer on the higher potential side of the electric field which is applied to the piezoelectric body layer, and which, by applying an electric field in the direction reverse to the electric field, repairs the piezoelectric body layer degraded, the second metal oxide layer contacting an opposite outer face of the piezoelectric body layer;

an electric field application section which applies an electric field to the piezoelectric element;

a degradation detection section which detects a degradation level of the piezoelectric element; and a control section which controls the electric field application section such that, when the degradation level detected by the degradation detection section is under a predetermined level and the ink liquid droplets are caused to be ejected, an electric field in the predetermined direction is applied to the piezoelectric element, and when the degradation level detected by the degradation detection section is equal to or over the predetermined level, an electric field in the direction reverse to the predetermined direction is applied to the piezoelectric element.

2. The piezoelectric element recovery apparatus of claim 1, wherein at least one of the first metal oxide layer or the second metal oxide layer is made up of an electrically non-conductive material, and an electrode layer made of a metal or an electrically conductive metal oxide is further provided in at least one of the first metal oxide layer and the second metal oxide layer made up of the electrically non-conductive material, on a face which is one of faces of the first metal oxide layer or the second metal oxide layer that is opposite to a face facing the piezoelectric body layer.

3. The piezoelectric element recovery apparatus of claim 1, wherein at least one of the first metal oxide layer and the second metal oxide layer is made up of a material containing at least one of iridium, tin, ruthenium, rhenium, rhodium, palladium, strontium, indium, titanium, zirconium, niobium, magnesium, silicon, tantalum, aluminum, zinc, manganese, cobalt, osmium, and hafnium.

4. The piezoelectric element recovery apparatus of claim 2, wherein at least one of the first metal oxide layer and the second metal oxide layer is made up of a material containing at least one of iridium, tin, ruthenium, rhenium, rhodium, palladium, strontium, indium, titanium, zirconium, niobium, magnesium, silicon, tantalum, aluminum, zinc, manganese, cobalt, osmium, and hafnium.

5. The piezoelectric element recovery apparatus of claim 1, wherein the piezoelectric body layer comprises a lead zirconate titanate (PZT) family material.

6. The piezoelectric element recovery apparatus of claim 1, wherein the piezoelectric body layer comprises a lead zirconate titanate (PZT) family material to which a donor is added.

7. The piezoelectric element recovery apparatus of claim 1, wherein the thickness of the piezoelectric body layer is in the range of 1 μm to 50 μm.

8. The piezoelectric element recovery apparatus of claim 1, wherein the thickness of the first metal oxide layer and the second metal oxide layer is in the range of 50 nm to 1 μm.

9. The piezoelectric element recovery apparatus of claim 8, wherein the thickness of the first metal oxide layer and the second metal oxide layer is in the range of 100 nm to 0.5 μm.

10. The piezoelectric element recovery apparatus of claim 3, wherein the thickness of the first metal oxide layer and the second metal oxide layer is in the range of 50 nm to 1 μm.

11. The piezoelectric element recovery apparatus of claim 10, wherein the thickness of the first metal oxide layer and the second metal oxide layer is in the range of 100 nm to 0.5 μm.

12. The piezoelectric element recovery apparatus of claim 2, wherein the combined thickness of the metal oxide layer and the electrode layer is in the range of 50 nm to 1 μm.

13. A liquid droplet ejection apparatus comprising:

at least one piezoelectric element including:

a single piezoelectric body layer which is deformed by an applied electric field;

a first metal oxide layer which is disposed directly adjacent to the piezoelectric body layer on the lower potential side when an electric field in a predetermined direction is applied to the piezoelectric body layer, and which suppresses degradation of the piezoelectric body layer that is caused by application of the electric field, the first metal oxide layer contacting an outer face of the piezoelectric body layer; and a second metal oxide layer which is disposed directly adjacent to the piezoelectric body layer on the higher potential side of the electric field which is applied to the piezoelectric body layer, and which, by applying an electric field in the direction reverse to the electric field, repairs the piezoelectric body layer degraded, the second metal oxide layer contacting an opposite outer face of the piezoelectric body layer;

a plurality of pressure generating chambers which are each provided for each respective piezoelectric element, and whose inner volume which is filled with ink liquid droplets is changed, the pressure generating chambers being pressurized from the outside by the deformation of the piezoelectric body layer provided in the piezoelectric element;

a liquid droplet ejection port which is connected to each pressure generating chamber, and ejects the ink liquid droplets by a pressure wave generated by the change in volume of the pressure generating chamber;

an electric field application section which applies an electric field to the piezoelectric element;

a degradation detection section which detects a degradation level of the piezoelectric element; and a control section which controls the electric field application section such that, when the degradation level detected by the degradation detection section is under a predetermined level and the ink liquid droplets are caused to be ejected, an electric field in the predetermined direction is applied to the piezoelectric element, and when the degradation level detected by the degradation detection section is equal to or over the predetermined level, an electric field in the direction reverse to the predetermined direction is applied to the piezoelectric element.

14. The liquid droplet ejection apparatus of claim 13, wherein at least one of the first metal oxide layer or the second metal oxide layer is made up of an electrically non-conductive material, and an electrode layer made of a metal or an electrically conductive metal oxide is further provided in at least one of the first metal oxide layer and the second metal oxide layer made up of the electrically non-conductive material, on a face which is one of faces of the first metal oxide layer or the second metal oxide layer that is opposite to a face facing the piezoelectric body layer.

15. The liquid droplet ejection apparatus of claim 13, wherein at least one of the first metal oxide layer and the second metal oxide layer is made up of a material containing at least one of iridium, tin, ruthenium, rhenium, rhodium, palladium, strontium, indium, titanium, zirconium, niobium, magnesium, silicon, tantalum, aluminum, zinc, manganese, cobalt, osmium, and hafnium.

16. The liquid droplet ejection apparatus of claim 13 further comprising:

a diaphragm which constitutes at least a part of the wall surface of the pressure generating chamber, and dilates and contracts the pressure generating chamber by vibrating; and an actuator comprising at least a piezoelectric element which vibrates the diaphragm, the piezoelectric element being deformed by the voltage applied in accordance with the image information.

17. The piezoelectric element recovery apparatus of claim 1, wherein the degradation detection section detects the degradation level of the piezoelectric element on the basis of the change in the electrical characteristic of the piezoelectric element.

18. The liquid droplet ejection apparatus of claim 13, wherein, when the electric field application section applies the electric field in the direction reverse to the predetermined direction, it applies, to the piezoelectric element in the direction reverse to the predetermined direction, a voltage whose value is lower than the predetermined voltage which is applied to the piezoelectric element when the electric field is applied in the predetermined direction, and whose frequency is higher than the predetermined frequency which is applied to the piezoelectric element in the direction reverse to the predetermined direction.

19. The piezoelectric element recovery apparatus of claim 1, wherein, when the electric field application section applies the electric field in the direction reverse to the predetermined direction, it applies, to the piezoelectric element in the direction reverse to the predetermined direction, a voltage whose value is lower than the predetermined voltage which is applied to the piezoelectric element when the electric field is applied in the predetermined direction, and whose frequency is higher than the predetermined frequency which is applied to the piezoelectric element in the direction reverse to the predetermined direction.

20. The piezoelectric element recovery apparatus of claim 17, wherein the electrical characteristic of the piezoelectric element includes resistance or capacitance.

21. The piezoelectric element recovery apparatus of claim 1, wherein the controller decreases the frequency of use of the piezoelectric element if the degradation level detected by the degradation detection section is under the predetermined level after applying an electric field in the direction reverse to the predetermined direction to the piezoelectric element.

22. The piezoelectric element recovery apparatus of claim 1, further comprising:

a humidity sensor which detects the humidity around the piezoelectric element, wherein the controller applies an electric field in the direction reverse to the predetermined direction to the piezoelectric element if a number of times the piezoelectric element is driven, when the humidity detected by the humidity sensor exceeds a predetermined humidity level, exceeds a predetermined number.

* * * * *